US009392924B2

(12) United States Patent
Bertsch et al.

(10) Patent No.: US 9,392,924 B2
(45) Date of Patent: Jul. 19, 2016

(54) DISHWASHER WITH BOOSTER AGENT DISPERSAL SYSTEM

(71) Applicant: Whirlpool Corporation, Benton Harbor, MI (US)

(72) Inventors: Roger J. Bertsch, Stevensville, MI (US); David H. Chen, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/693,024

(22) Filed: Apr. 22, 2015

(65) Prior Publication Data

US 2015/0223665 A1 Aug. 13, 2015

Related U.S. Application Data

(62) Division of application No. 13/615,931, filed on Sep. 14, 2012, now Pat. No. 9,034,114.

(51) Int. Cl.

| | |
|---|---|
| ***A47L 15/42*** | (2006.01) |
| ***A47L 15/00*** | (2006.01) |
| ***A47L 15/44*** | (2006.01) |
| ***A47L 15/50*** | (2006.01) |

(52) U.S. Cl.

CPC ..... *A47L 15/0007* (2013.01); *A47L 15/4219* (2013.01); *A47L 15/44* (2013.01); *A47L 15/4445* (2013.01); *A47L 15/50* (2013.01); *A47L 15/508* (2013.01); *A47L 15/4463* (2013.01)

(58) Field of Classification Search

CPC ..... A47L 15/421

See application file for complete search history.

(56) References Cited

U.S. PATENT DOCUMENTS

| | | | | |
|---|---|---|---|---|
| 5,235,994 | A * | 8/1993 | Comin | A47L 15/44 134/176 |
| 7,754,024 | B2 * | 7/2010 | Koch | A47L 15/16 134/137 |
| 2010/0139719 | A1 * | 6/2010 | Gnadinger | A47L 15/23 134/56 D |

* cited by examiner

*Primary Examiner* — Jason Ko

(57) ABSTRACT

A dishwasher includes a shiftable rack provided with a washing agent dispersal system including a housing into which washing fluid is delivered. When the rack is shifted to a retracted position within a tub of the dishwasher, a tube feed system is employed to selectively distribute washing fluid from a pump assembly to each of multiple spray arms, the housing of the washing agent dispersal system and an auxiliary spray unit carried by the upper rack.

20 Claims, 5 Drawing Sheets

DISHWASHER WITH BOOSTER AGENT DISPERSAL SYSTEM

CROSS-REFERENCE TO RELATED APPLICATIONS

The present represents a divisional application of U.S. patent application Ser. No. 13/615,931 filed Sep. 14, 2012 entitled "Dishwasher with Booster Agent Dispersal System".

BACKGROUND OF THE INVENTION

1. Field of the Invention

The present invention pertains to the art of dishwashers and, more particularly, to a dishwasher including a system for adding a washing agent into a washing chamber by delivering washing fluid to a booster agent dispenser provided on an upper rack of the dishwasher during a select portion of an overall washing operation.

2. Description of the Related Art

In the art of dishwashers, it is known to provide multiple, vertically spaced spray arms within a single wash tub in order to enhance the spray patterns of washing fluid. For use with these various spray arm arrangements, many different types of fluid distribution systems have been developed to address different problems or to provide a dishwasher with specific functionality. For instance, in order to increase the distribution of washing fluid, it is known in the art to provide a dishwasher tub with a lower, rotatable spray arm mounted for rotation below a lower rack, an upper, rotatable spray arm mounted above an upper rack and an intermediate, rotatable spray arm provided below the upper rack. In such an arrangement, the intermediate spray arm is mounted to the upper rack for concurrent movement into and out of the tub of the dishwasher. To accommodate this movement, a fluid connection must be made to the intermediate spray arm upon retraction of the upper rack into the tub.

If the upper rack is vertically adjustable, additional provisions must be made to provide the necessary fluid connection when the upper rack is in each of the various vertical orientations. In general, this adjustability function is accomplished by fixedly mounting a valve and manifold assembly to the tub at the height of the upper rack, with the manifold including multiple ports which can be alternatively accessed to provide the requisite washing fluid flow to the intermediate spray arm.

As an additional consideration, it can be desirable to provide a flow control system to regulate the flow timing to each of the spray arms. For instance, based on water pressure or other reasons, it may not be feasible to provide flow to each of the spray arms simultaneously. If this is the case, separate and distinct fluid conduits and/or complicated valving may be employed in combination with a water diverter mechanism in order to selectively direct the washing fluid to the lower wash arm, the upper wash arm, the intermediate wash arm or certain combinations of the wash arms.

As a still further consideration, it can be desirable to enable the timed delivery of additional washing agent into a dishwashing chamber in connection with the regulated flow to the spray arms. In this regard, many attempts have been made in the art of dishwashers to provide improved detergent dispersion and effectiveness. One solution to the problem involves directing a cleaning agent from a dispenser directly into a spray arm. Examples of this type of dispenser are demonstrated by UK Patent Application No. GB 2321590 and U.S. Pat. No. 5,235,994. Another solution involves impinging washing fluid from a rotating spray arm directly into an exposed dispenser container to slowly dissolve and distribute a cleaning agent, as demonstrated by International Publication WO 2009/083576. It is also known in the art to provide an auxiliary dispenser for enhancing the performance of a dishwasher as taught by U.S. Pat. No. 7,475,696.

With all the above in mind, there is still seen to be a need in the art of dishwashers for an improved cleaning agent dispersal system for use in selectively supplementing the operation of a standard detergent dispenser in providing an optimal amount of detergent during distinct portions of an overall washing operation. More specifically, it is seen as beneficial to provide a dispenser that can be easily accessed by a user and selectively utilized to aide in the cleaning of kitchenware by quickly and effectively distributing a chemical agent within a dishwashing chamber, particularly during the distribution of washing fluid to one or more auxiliary spray units provided on an upper rack of a dishwasher.

SUMMARY OF THE INVENTION

The present invention provides for an enhanced dishwasher washing system including, in addition to the potential for lower and upper spray arms within a tub of the dishwasher, an upper rack carrying a booster agent dispenser and at least one auxiliary spray unit. A fluid distribution system, including a multi-tube feed arrangement in combination with a rack supported manifold, is employed to provide for selective distribution of washing fluid to a housing of the booster agent dispenser and the auxiliary spray unit.

In accordance with one embodiment of the invention, the booster agent dispenser includes a drawer slidably mounted for movement into and out of the housing, with the drawer being configured to receive a washing agent. In another embodiment, the housing is located in a corner region of the upper rack, preferably with the housing having a sloped bottom wall portion which covers or extends over at least part of an auxiliary spray unit. In either case, during a select portion of an overall washing operation, the fluid distribution system directs washing fluid into the housing, causing the washing fluid to mix with the washing agent and the mixture to be dispersed into the tub, such as through a series of dispersal openings provided in one or more outer walls of the housing.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
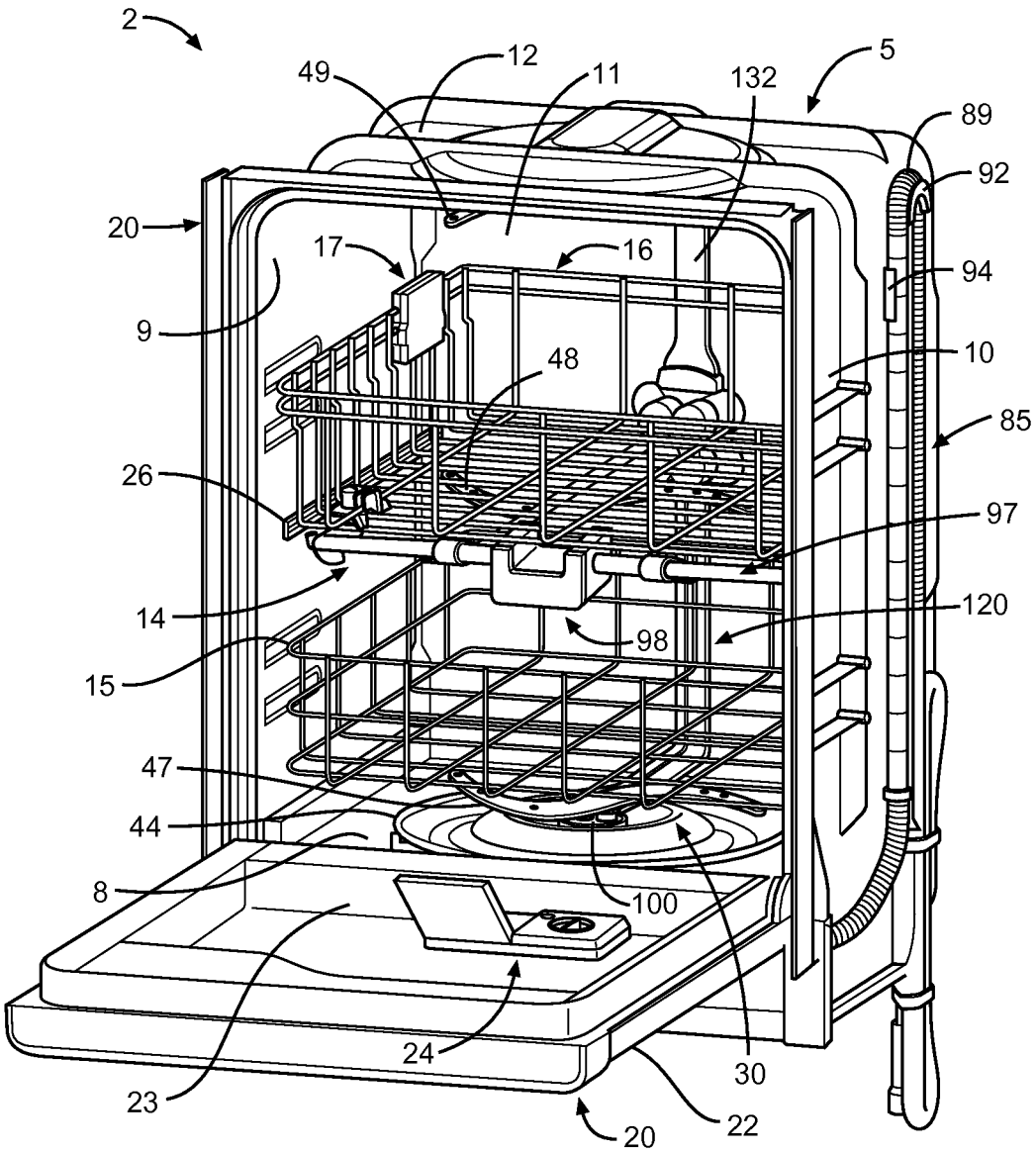
FIG. 1 is a perspective view of a dishwasher incorporating a booster agent dispersal system constructed in accordance with a first embodiment of the invention.

With initial reference to FIG. 1, a dishwasher constructed in accordance with the present invention is generally indicated at 2. As shown, dishwasher 2 includes a tub 5, which is preferably injection molded of plastic, so as to include integral bottom, side, rear and top walls 8-12 respectively. Within the confines of walls 8-12, tub 5 defines a washing chamber 14 within which soiled kitchenware is adapted to be placed on a lower dish rack 15 and/or an adjustable upper rack 16 which is mounted through an adjustment mechanism 17 for vertically shifting upper rack 16 between a first or lowered position and a second or raised position. As the particulars of adjustment mechanism 17 do not form part of the invention, they will not be described further here. Instead, an adjustment mechanism known in the art can be employed, such as that disclosed in U.S. Pat. No. 7,410,228 incorporated herein by reference. As shown in this figure, tub 5 pivotally supports a door 20, having an exterior panel 22, an interior panel 23 and a main washing agent or detergent dispenser 24, used to seal washing chamber 14 during a washing operation.

In a manner known in the art, upper rack 16 is horizontally shiftable between a first, retracted position wherein upper rack 16 is entirely within the confines of washing chamber 14 as shown in FIG. 1 and a second, extended position, wherein upper dish rack 16 projects, at least partially outward, from washing chamber 14. Toward that end, dishwasher 2 is provided with extensible support members, one of which is indicated generally at 26. In a similar manner, lower dish rack 15 is selectively, horizontally shiftable between retracted and extended positions. However, when in the extended position, lower dish rack 15 rests upon an open door 20 on guide elements (not separately labeled) formed on interior panel 23.

Disposed within tub 5 and, more specifically, mounted within a central opening formed in bottom wall 8 of tub 5, is a pump assembly 30 constructed in a manner known in the art, such as that represented by U.S. Pat. No. 7,146,992 which is incorporated herein by reference. Extending about a substantial portion of pump assembly 30, at a position raised above bottom wall 8, is a heating element 44. In a manner known in the art, heating element 44 preferably takes the form of a sheathed, electric resistance-type heating element. In the embodiment shown, pump assembly 30 is adapted to direct washing fluid to a lower spray arm 47, an intermediate spray arm 48 and an upper arm 49.

For the sake of completeness, dishwasher 2 also has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In this manner, an upper loop is maintained in drain hose 85 to assure proper drainage in a manner known in the art. As the exact structure and operation of pump assembly 30 of dishwasher 2 is not part of the present invention, it will not be discussed further herein. Instead, the present invention is directed to particulars of the washing system associated with upper rack 16. More specifically, the invention is concerned with the manner in which washing fluid can be selectively delivered from pump assembly 30 through a fluid distribution or feed tube system and a booster agent dispenser 98 carried by upper rack 16.

Figure 2:
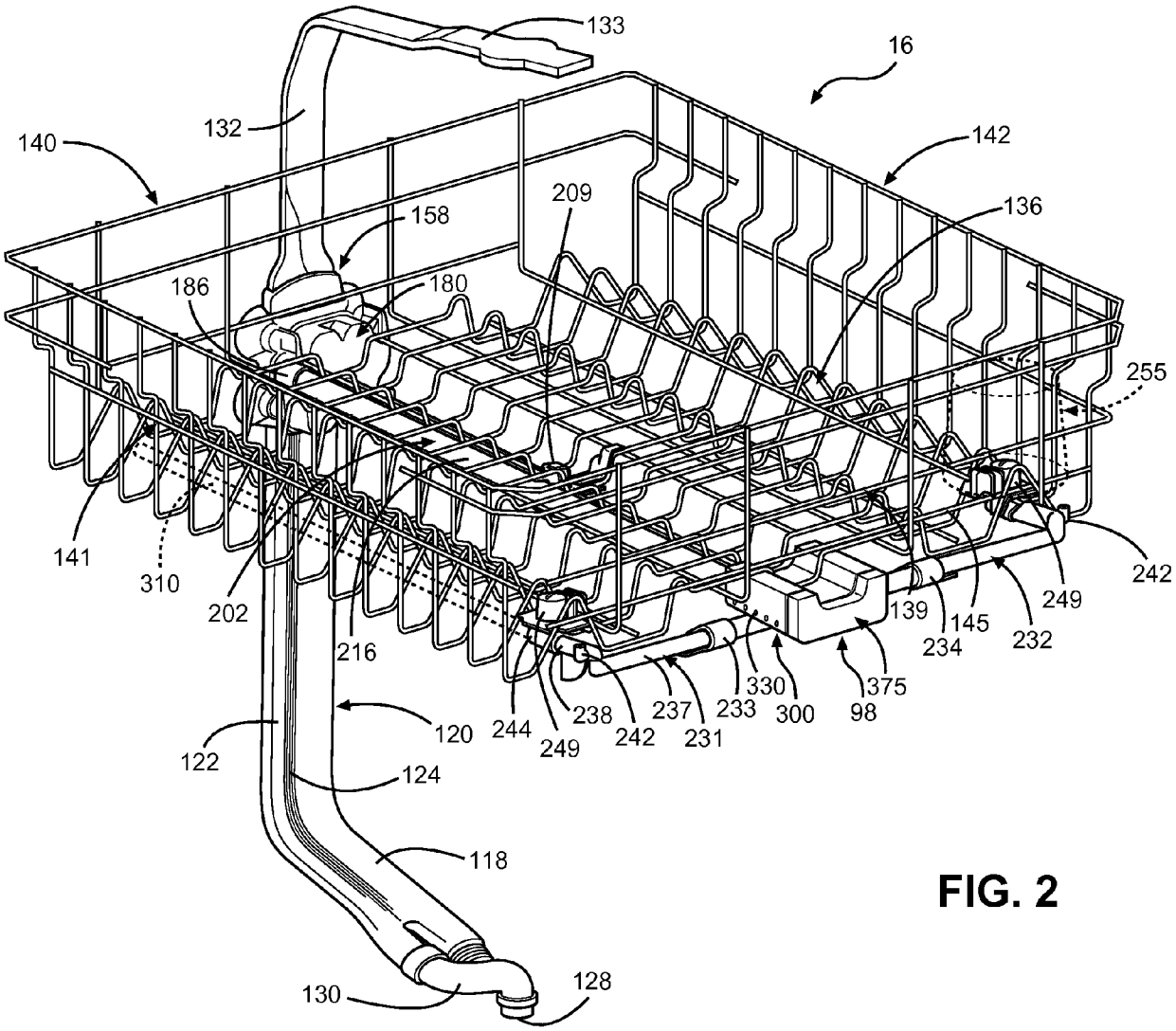
FIG. 2 is a perspective view of an upper rack and feed tube arrangement associated with the booster agent dispersal system of FIG. 1.

In connection with the flow of washing fluid, FIG. 2 depicts an enlarged view of a distribution system connected to a distribution head 100 (FIG. 1) provided atop pump assembly 30. As shown, this distribution system includes a first tube 118 of a multi-tube feed arrangement generally indicated at 120, which is adapted to receive a flow of washing fluid from pump assembly 30. Multi-tube feed arrangement 120 also includes a second tube 122 that is shown to be interconnected to first tube 118 through a web 124. Preferably, first and second tubes 118 and 122 are formed together to establish a unitary conduit assembly even though first tube 118 and second tube 122 are completely separate and distinct with respect to their isolated fluid flows. Mounted to an end of second tube 122 is a connector 128 that is part of a rotatable leg 130 which fluidly interconnects second tube 122 to distribution head 100.

With reference to FIGS. 1 and 2, multi-tube feed arrangement 120 leads away from pump assembly 30 towards rear wall 11 of tub 5 and extends up rear wall 11. Above upper rack 16, second tube 122 terminates and first tube 118 of multi-tube feed arrangement 120 transitions into an upright tube extension 132 and a horizontal tube extension 133 which project above upper rack 16. Rotatably attached to horizontal tube extension 133 is upper spray arm 49 (FIG. 1 only). As best shown in FIG. 2, upper rack 16 includes a base 136, a front wall portion 139, rear wall portion 140 and side wall portions 141 and 142. In the embodiment shown, upper rack 16 is formed from a plurality of interconnected, plastic coated wires, one of which is indicated at 145 to be part of front wall portion 139. At this point, it should be realized that the actual layout of wires 145 for upper rack 16 can greatly vary in accordance with the present invention and such types of wire racks are widely known in the art. Of course, upper rack 16 could be made from other materials as well.

As shown in FIG. 2, first tube 118 and second tube 122 extend through a junction 158. Junction 158 is provided with various ports (not separately labeled) which open up to first tube 118 and second tube 122 respectively. Secured at junction 158 is a manifold 180 having a port 186 from which extends a first upper distribution tube assembly 202. At an intermediate section (not labeled) of upper rack 16, first upper distribution tube assembly 202 is supported by a mounting bracket 209 which also aids in attaching manifold 180 to upper rack 16 for concurrent movement. At this point, it should be noted that additional distribution tubes can extend from manifold 180 to supply other spray units, including intermediate spray arm 48.

At this point, it should be noted that distribution head 100 preferably provides for multiple distinct flows which are regulated during a washing operation such that the flows are not simultaneously provided in order to enhance flow pressure. In connection with regulating these various flows, a diverter valve unit (not shown) is provided beneath head 100 and incorporated into pump assembly 30. In general, the function and operation of a diverter valve unit in the dishwasher art is known as evidenced by the disclosure in U.S. Pat. No. 7,914,625, incorporated herein by reference. Therefore, as the specific details of the operation of diverter valve unit 126 is not considered part of the present invention such that it will not be further discussed herein. Instead, it is merely important to recognize that the distribution of washing fluid to the various components of the overall dishwasher can be controlled throughout a washing operation, such as based on user washing selections.

More specific to the invention, it is desired to increase the washing agent concentration during certain portions of a washing operation. To this end, in order to supplement the dispersal of washing agent from dispenser 24, the invention provides for the introduction of additional washing agent which, in this embodiment, is provided for through an overall booster agent dispersal system. For this purpose, washing fluid must be supplied to booster agent dispenser 98. With this in mind, first upper distribution tube assembly 202 is shown formed from multiple, interconnected pieces, including a flow tube 216 coupled to port 186 of manifold 180 and leading to a T-connector (not shown) beneath booster agent dispenser 98. With this arrangement, the flow in flow tube 216 is bifurcated so as to flow in opposing directions into a pair of sub-arm assemblies 231 and 232 hung on upper rack 16 by brackets 233 and 234, while a portion of the flow is directed into booster agent dispenser 98 as detailed more fully below.

As each sub-arm assembly 231, 232 is identically constructed, details will now be made of sub-arm assembly 231 and it is to be understood that sub-arm assembly 232 has corresponding structure. As clearly shown in FIG. 2, sub-arm assembly 231 includes a first leg 237 and a second leg 238. Given the generally rectangular configuration of upper rack 16, first leg 237 and second leg 238 are generally arranged perpendicular to one another. Certainly, other configurations are possible in order to conform to a desired shape of upper rack 16 and to enhance fluid flow. As also shown in these figures, an exterior corner nozzle 242 is provided at the junction between first leg 237 and second leg 238. Sub-arm assembly 231 also includes a transition tube 244 connected to second leg 238 and having mounted thereto an interior corner nozzle 249 over which a glass or other container, such as shown at 255 for sub-arm assembly 232, can be placed. Further details of the corner nozzle arrangement and flow thereto can be found in pending U.S. patent application Ser. No. 13/105,020 entitled "Dishwasher with Multi-Feed Washing System" and U.S. patent application Ser. No. 13/105,075 entitled "Dishwasher With Rack Corner Spray System", both of which were filed on May 11, 2011 and are incorporated herein by reference.

Figure 3:
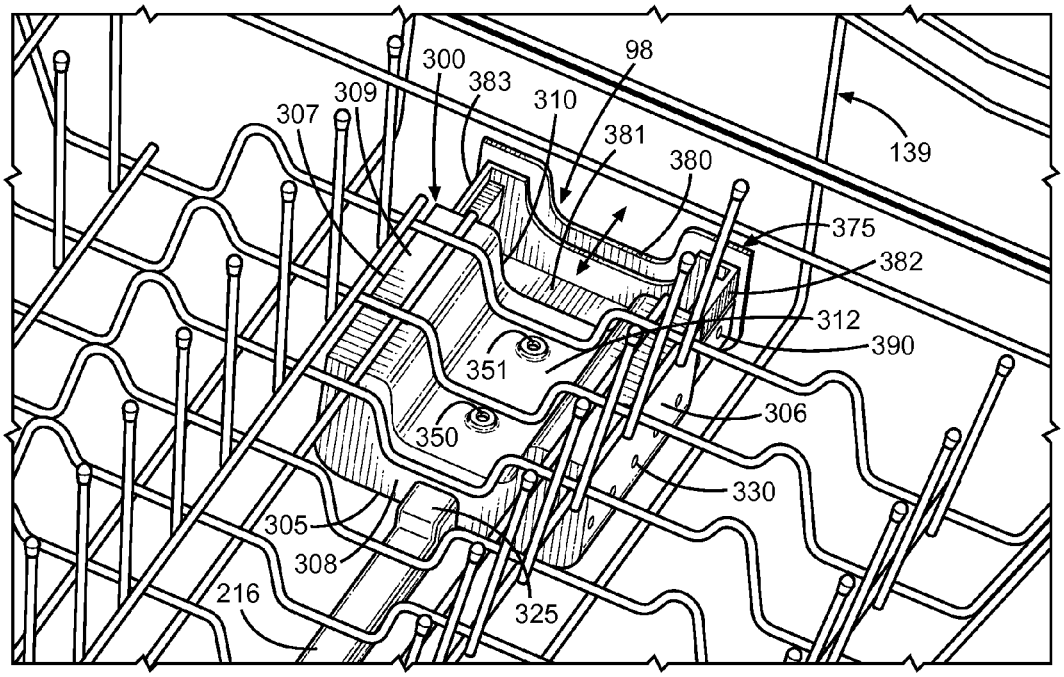
FIG. 3 is a perspective view of a frontal portion of the upper rack of FIG. 2, detailing aspects of the first embodiment.

Reference will now be made to FIGS. 2 and 3 in detailing a preferred construction for booster agent dispenser 98. As shown, booster agent dispenser 98 includes a housing 300 having a bottom wall 305, side walls 306 and 307, a rear wall 308 and a top wall 309. Housing 300 is provided with an open front indicated at 310. Also, basically to conform to the construction of upper rack 16, top wall 309 is shown to be provided with a recessed central portion 312. As indicated above, a portion of the flow through flow tube 216 is directed into booster agent dispenser 98. For this purpose, an inlet tube 325 is open to flow tube 216 in order to direct washing fluid directly into housing 300, in this embodiment directly through rear wall 308. In addition to this structure, housing 300 is shown to include a plurality of side discharge openings 330 in side wall 306, while it should be understood that a corresponding set of discharge openings is preferably provided on side wall 307. In addition, upper discharge apertures 350 and 351 are formed in recessed central portion 312.

Booster agent dispenser 98 also includes a drawer 375 including a front wall 380, a bottom wall 381 and side walls 382 and 383. Drawer 375 need not include a rear wall, but a reduced height wall or one with various openings could be provided. As also shown in these drawings, side wall 382 is formed with a plurality of side discharge openings 390 and, much like the inclusion of side discharge openings in side wall 307, side wall 383 of drawer 375 is also preferably provided with corresponding openings.

With this arrangement, drawer 375 can be slid relative to housing 300 between an extended position as shown partially in FIG. 3 and a retracted position as shown in FIG. 2. When drawer 375 is extended, washing agent, such as liquid, powdered or tablet detergent (or even a rinsing aid), can be introduced into drawer 375 and then drawer 375 is retracted to within housing 300. Based on the particular washing operation selected by a user, pump 30 can be caused to direct a flow of washing fluid into manifold 180 which will then lead a portion of that fluid to first upper distribution tube assembly 202. More specifically, the fluid will flow into flow tube 216 and be directed to sub-arm assemblies 231 and 232, while eventually being sprayed from auxiliary spray units defined here by exterior corner nozzles 242 and interior corner nozzles 249. At the same time, a portion of that fluid will flow through inlet tube 325 and be introduced into housing 300, thereby mixing with the washing agent introduced into drawer 375. This mixture will be caused to flow out of drawer 375 and housing 300 through the plurality of side discharge openings 390 and the open top portion of drawer 375, in combination with the plurality of side discharge openings 330 and the upper discharge apertures 350 and 351. This mixture of booster washing agent will then be directed down into the bottom of tub 5 so as to be drawn in by pump 30 and reintroduced into the overall washing system.

At this point, it should be recognized that the frontal positioning and operation of booster agent dispenser 98 is extremely convenient as drawer 375 is readily accessible such that it can be easily withdrawn from within housing 300 and loaded with washing agent. If a solid washing agent tablet, disk or the like is employed, booster agent dispenser 98 can be loaded once with washing agent which can then be utilized for multiple washing cycles. In addition, if desired, drawer 375 can be readily slid from housing 300 and itself placed in upper rack 16 for washing. Although booster agent dispenser 98 is shown used in combination with auxiliary spray units in the form of exterior and interior corner nozzles 242 and 249, it should be readily apparent that various other configurations could also be employed. For instance, flow tube 216 can go directly into housing 300 from which sub-arm assemblies 231 and 232 can project. In this case, the added washing agent mixture will be introduced through the auxiliary spray units. At the same time, intermediate spray arm 48 can receive a flow of fluid directly from flow tube 216, or a separate flow tube stemming from manifold 180. In addition, it is possible to tap off a flow from flow tube 216 at various portions between rear wall portion 140 and front wall portion 139 of upper rack 16 such that, for example, either flow tube 216 or an additional flow tube stemming from manifold 180 could be bifurcated adjacent rear wall portion 140 to provide corner nozzles at the junctions of rear wall portion 140 and side wall portions 141 and 142 and/or the junction of side wall portions 141 and 142 and front wall portion 139. In any case, it should be readily apparent that there are various ways in which washing fluid can be directed into housing 300 and drawer 375 of booster agent dispenser 98, as well as at least one auxiliary spray unit such as nozzle 242 or nozzle 249, and even intermediate spray arm 48, without departing from the invention.

Figure 4:
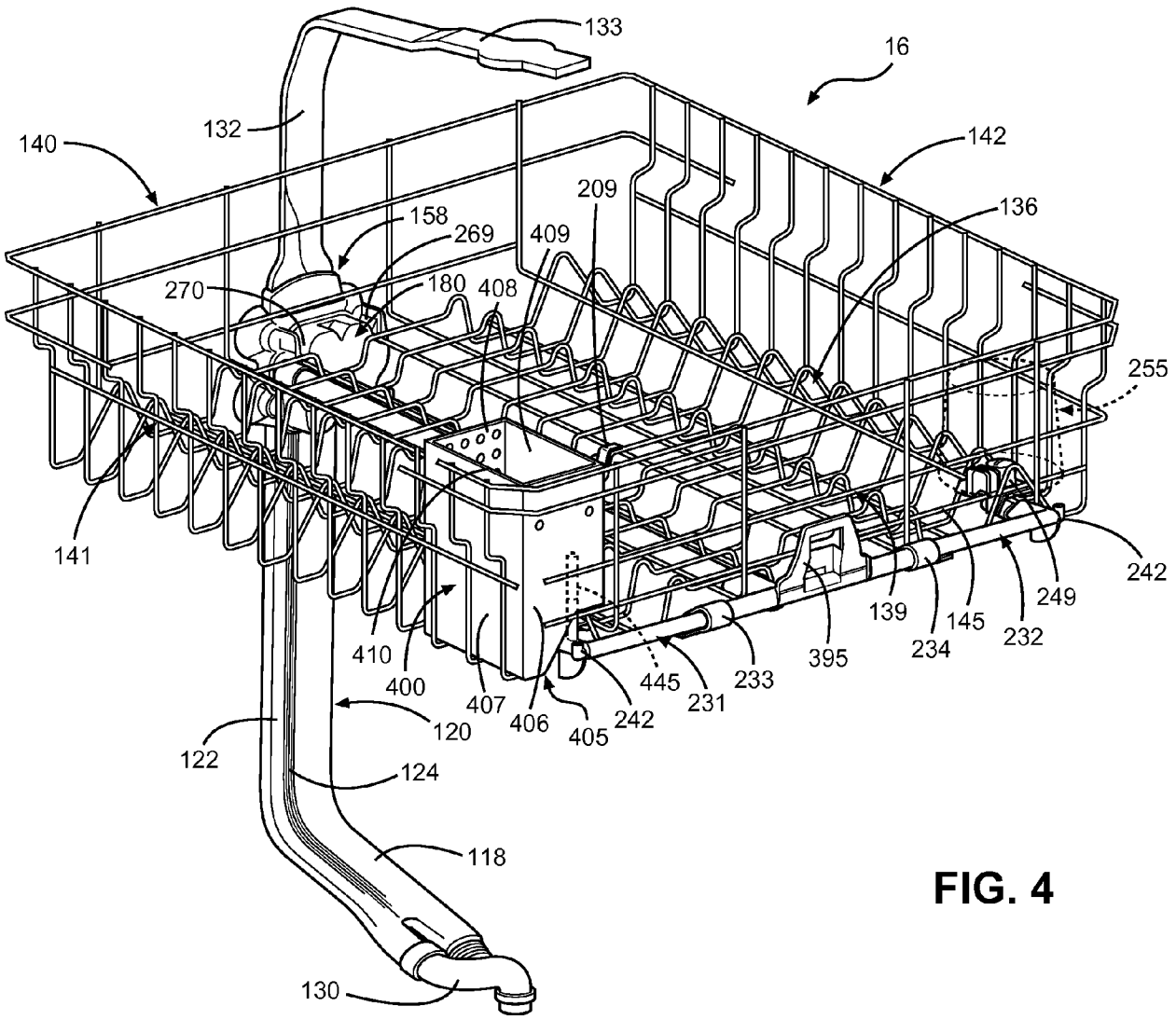
FIG. 4 is a perspective view of an upper rack and feed tube arrangement similar to FIG. 2 but illustrating a washing agent dispersal system constructed in accordance with a second embodiment of the invention.
Figure 5:
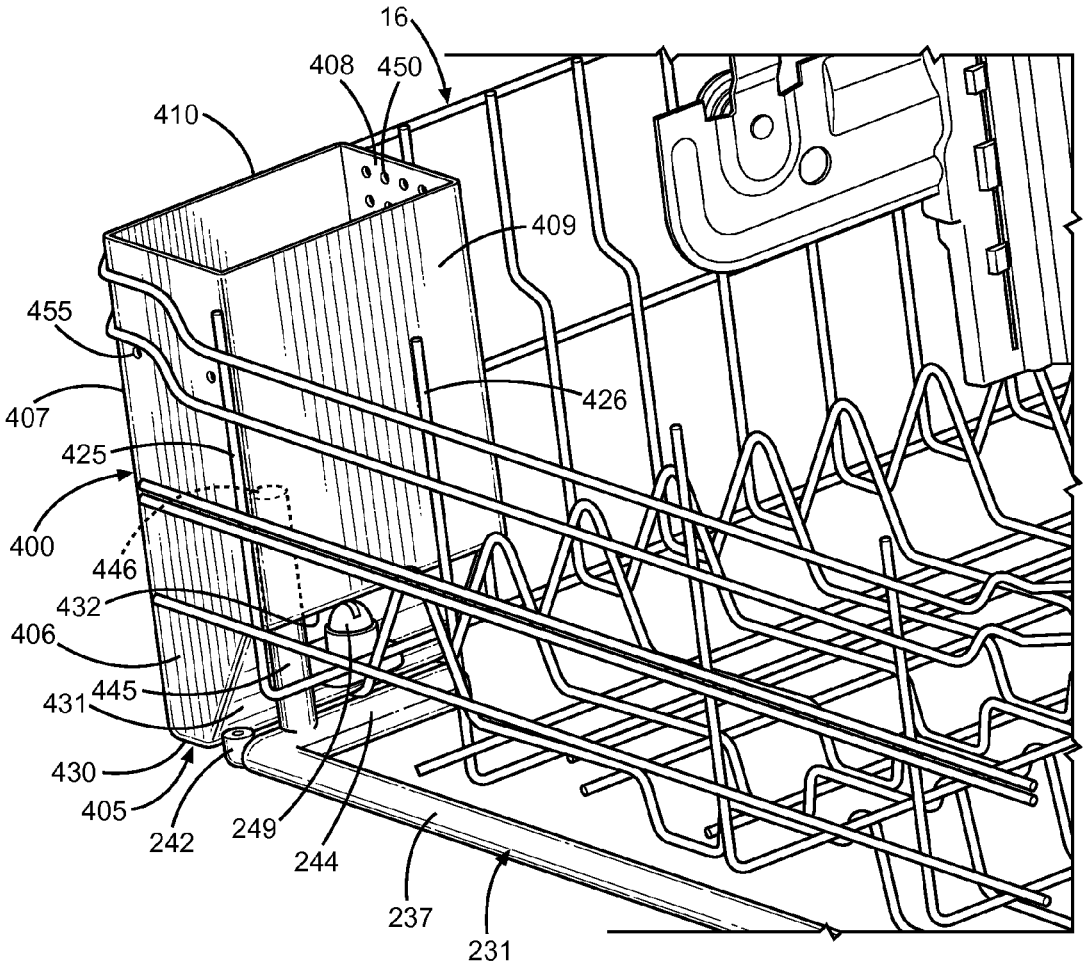
FIG. 5 is an enlarged perspective view of a corner portion of the upper rack of FIG. 4, detailing aspects of the second embodiment.

Reference will now be made to FIGS. 4 and 5 in describing another embodiment of the invention. In accordance with this embodiment, booster agent dispenser 98 has been removed and at a corresponding location is placed a T-bracket 395. Instead of employing booster agent dispenser 98, this embodiment employs a booster agent dispenser including a housing 400 arranged at a frontal corner portion (shown here at the juncture of side wall portion 141 and front wall portion 139 of upper rack 16). As depicted, housing 400 includes a bottom 405, side walls 406-409 and an open top 410. A cover (not shown) can be removably secured at top 410 to provide selective access to within housing 400. For use in connection with retaining housing 400 in a desired position, upper rack 16 is preferably provided with at least a couple upstanding wires or rods 425 and 426 which nest housing 400 against front wall portion 139 and side wall portion 141. In addition, bottom 405 is shown to include a first bottom section 430 leading to a sloped bottom section 431 and then to a second bottom section 432. As depicted, first and second bottom sections 430 and 432 are arranged generally parallel to each other and extend substantially horizontally in offset planes.

With this arrangement, housing 400 not only conforms to the configuration of upper rack 16, but still accommodates interior corner nozzle 249 at least partially below bottom 405 of housing 400. That is, since intermediate spray arm 48 rotates in a circular pattern and upper rack 16 is generally rectangular, the corner portions of upper rack 16 can often receive a lesser amount of washing fluid spray. It is for this reason that exterior and interior corner nozzles 242 and 249 are preferably provided, with the configuration of housing 400 advantageously enabling these nozzles to retain their desired functions.

Given open top 410, housing 400 can be readily loaded with a washing agent, such as in tablet form. To enable dispersion of the washing agent, a hole (not shown) is formed in second bottom section 432 and has projecting there through a supply tube 445 that stems from sub-arm assembly 231. Supply tube 445 includes an open upper end 246. With this arrangement, washing fluid directed into flow tube 216 and sub-arm assembly 231 will lead to each of exterior corner nozzle 242, interior corner nozzle 249 and supply tube 445. The portion of washing fluid flowing into supply tube 445 will exit upper end 446 and function to mix with the washing agent within housing 400. In order to disperse the mixture, housing 400 is provided with a plurality of discharge openings. In the embodiment shown, housing 400 is depicted as having a first plurality of side discharge openings 450 arranged along side wall 408. Certainly, various other discharge openings, such as a second plurality of side discharge openings in side wall 406, such as indicated at 455, can also be provided.

As with the embodiment of FIGS. 2 and 3, it should be readily apparent that the flow of washing fluid into housing 400 can be achieved in various ways. In this particular instance, T-bracket 495 bifurcates the flow from flow tube 216 to sub-arm assemblies 231 and 232 at front wall portion 139 of upper rack 16. However, this bifurcation can take place at rear wall portion 140, or even intermediate front and rear walls portions 139 and 140, with flow tube 216 being easily routed based on its fixed positioning relative to upper rack 16. In addition, housing 400 could be arranged in series with the auxiliary spray unit(s) as described above. Furthermore, although housing 400 is preferably provided at a frontal portion of upper rack 16 for convenience of loading and the like, it is possible to repositioning housing 400 into other portions of upper rack 16, such as anywhere along the interior periphery.

With this overall arrangement, it should be readily apparent that dishwasher 2 of the present invention can provide for a series of timed and controlled flow patterns for washing fluid, whether during a wash cycle or a rinse cycle. Based on the timing established for the flow of fluid into manifold 180 through distribution head 100, the booster agent dispenser system of the invention can be effectively utilized to supplement any initial washing agents provided for the washing operation utilizing dispenser 24. As the majority of the washing agent provided by dispenser 24 would be lost from tub 5 during draining operations, the inclusion of the booster agent dispenser system enables the washing level concentration to be substantially increased during latter portions of the washing operation, particularly to assure the effectiveness of the auxiliary corner spray units. In case, although described with reference to preferred embodiments of the invention, it should be readily understood that various changes and/or modifications can be made to the invention without departing from the spirit thereof. In general, the invention is only intended to be limited by the scope of the following claims.

The invention claimed is:

1. A method of performing a washing operation in a dishwasher comprising:

directing a first flow of washing fluid from a pump assembly to a first rotatable spray arm for a lower rack of the dishwasher;

directing a second flow of washing fluid from the pump assembly to a first tube leading to a second rotatable spray arm for an upper rack of the dishwasher; and directing a third flow of washing fluid from the pump assembly to a second tube and into each of an non-rotatable auxiliary spray unit and a housing of a washing agent dispenser, with both mounted to the upper rack.

2. The method of claim 1, further comprising: loading the washing agent dispenser with a washing agent by slidably shifting a drawer portion of the washing agent dispenser relative to a housing portion thereof.

3. The method of claim 2, further comprising: slidably shifting the drawer portion away from a front wall portion of the upper rack.

4. The method of claim 1, wherein directing the third flow of washing fluid to the auxiliary spray unit constitutes directing the third flow to a corner spray unit provided on the upper rack.

5. The method of claim 4, further comprising: spraying the third flow of washing fluid from the corner spray unit from a position at least partially below a bottom wall of the housing.

6. The method of claim 1, further comprising: rotating each of the first and second spray arms when the first and second flows of washing fluid are directed to the first and second spray arms respectively.

7. The method of claim 6, further comprising: maintaining the auxiliary spray unit non-rotatably mounted to the upper rack when the third flow of washing fluid is directed to the auxiliary spray unit.

8. The method of claim 1, further comprising:

shifting the upper rack relative to a tub of the dishwasher between an extended position and a retracted, operational position; and fluidly interconnecting the second tube to a manifold, which is mounted to the upper rack for movement with the upper rack relative to the tub, when the upper rack is placed in the retracted, operational position.

9. The method of claim 1, wherein the upper rack includes a base, a front wall portion, a rear wall portion and side wall portions, the housing of said washing agent dispenser being exposed at the front wall portion of the upper rack, said method further comprising introducing a washing agent into the housing through an open upper portion of the housing for the washing operation.

10. The method of claim 9, wherein the housing further includes a bottom wall having an upwardly and inwardly extending wall portion, said method further comprising spraying at least a portion of the third flow of washing fluid from the auxiliary spray unit from a position at least partially below the bottom wall of the housing.

11. The method of claim 1, further comprising: delivering the washing fluid from the pump to the washing agent dispenser and then from the washing agent dispenser to the auxiliary spray unit.

12. The method of claim 1, further comprising:

delivering the washing fluid from the washing agent dispenser to the auxiliary spray unit; and introducing the washing agent into a washing chamber defined by a tub of the dishwasher through the auxiliary spray unit.

13. A method of performing a washing operation in a dishwasher including a tub defining a washing chamber adapted to receive and cleanse soiled kitchenware, a door mounted to the tub for selectively sealing the washing chamber during the washing operation, a lower rack mounted to the tub for movement relative to the tub between a recessed, operational position within the washing chamber and an extended, kitchenware access position at least partially out of the washing chamber, a lower spray arm configured to direct washing fluid during the washing operation upon kitchenware placed on the lower rack, an upper rack mounted to the tub for movement relative to the tub between a retracted, operational position within the washing chamber and an extended, kitchenware access position at least partially out of the washing chamber, an upper spray arm configured to direct washing fluid during the washing operation upon kitchenware placed on the upper rack, an intermediate spray arm supported for movement with the upper rack and configured to direct washing fluid during the washing operation, at least one auxiliary spray unit mounted to the upper rack, a washing agent dispenser attached to and movable with the upper rack relative to the tub, said washing agent dispenser including a housing for receiving a washing agent, said method comprising:

operating a pump to circulate washing fluid within the washing chamber through a feed tube system during the washing operation; and delivering the washing fluid from the pump and the feed tube system to each of the lower spray arm, the upper spray arm, the at least one auxiliary spray unit and the washing agent dispenser.

14. The method of claim 13, wherein washing fluid is delivered to the at least one auxiliary spray unit at a corner portion of the upper rack.

15. The method of claim 13, further comprising: delivering washing fluid from the pump to the washing agent dispenser and then from the washing agent dispenser to the at least one auxiliary spray unit.

16. The method of claim 13, further comprising: introducing the washing agent into the washing chamber through the at least one auxiliary spray unit upon delivering washing fluid from the washing agent dispenser to the at least one auxiliary spray unit.

17. The method of claim 13, further comprising: loading the washing agent dispenser with a washing agent by slidably shifting a drawer portion of the washing agent dispenser relative to a housing portion thereof.

18. The method of claim 17, further comprising: slidably shifting the drawer portion away from a front wall portion of the upper rack.

19. The method of claim 13, wherein the upper rack includes a base, a front wall portion, a rear wall portion and side wall portions, the housing of said washing agent dispenser being exposed at the front wall portion of the upper rack, said method further comprising introducing a washing agent into the housing through an open upper portion of the housing for the washing operation.

20. The method of claim 19, wherein the housing further includes a bottom wall having an upwardly and inwardly extending wall portion, said method further comprising spraying at least a portion of the third flow of washing fluid from the at least one auxiliary spray unit from a position at least partially below the bottom wall of the housing.

* * * * *